US005519281A

United States Patent [19]

Jamar

[11] Patent Number: 5,519,281

[45] Date of Patent: May 21, 1996

[54] DISPLAY TUBE INCLUDING A CORRECTION COIL FOR GENERATING, IN OPERATION, AN AXIAL CORRECTION FIELD

[75] Inventor: Jacobus H. T. Jamar, Eindhoven, Netherlands

[73] Assignee: U.S. Philips Corporation, New York, N.Y.

[21] Appl. No.: 345,027

[22] Filed: Nov. 23, 1994

[30] Foreign Application Priority Data

Nov. 26, 1993 [BE] Belgium ..... 09301309
Dec. 16, 1993 [BE] Belgium ..... 09301398

[51] Int. Cl.[6] ..... H01J 29/70

[52] U.S. Cl. ..... 313/413; 313/431; 313/440; 313/442; 335/213

[58] Field of Search ..... 313/413, 426, 313/431, 440, 433, 442, 425; 335/210, 211, 213, 299, 296

[56] References Cited

U.S. PATENT DOCUMENTS 4,296,359 10/1981 Dodds ..... 313/213 X
4,415,831 11/1983 Konosu ..... 313/413
4,782,264 11/1988 Yamazaki et al. ..... 335/211 X
4,789,806 12/1988 Meershoek ..... 335/213 X
4,962,333 10/1990 Sluyterman ..... 313/413 X
5,117,151 5/1992 Sluyterman et al. ..... 313/431 X
5,233,267 8/1993 Tominga et al. ..... 313/413 X
5,306,982 4/1994 Maillot et al. ..... 313/413
5,355,050 10/1994 Sluyterman ..... 313/413 X

*Primary Examiner*—Sandra L. O'Shea
*Assistant Examiner*—Ashok Patel
*Attorney, Agent, or Firm*—Robert J. Kraus

[57] ABSTRACT

Display tube comprising a deflection unit provided with a (twist) correction device which includes an annular (twist) correction coil surrounding the tube neck, which coil, when energized by a circuit providing a (twist) correction current, generates a magnetic correction field in the axial direction of the display tube. According to the invention, the device also provides a 4-pole y field for correcting (twist) errors in the center of the display screen. This 4-pole y field can be generated by causing the turns of the annular coil to follow a path having four predetermined corrugations alternately facing the display screen and the electron gun.

6 Claims, 3 Drawing Sheets

DISPLAY TUBE INCLUDING A CORRECTION COIL FOR GENERATING, IN OPERATION, AN AXIAL CORRECTION FIELD

BACKGROUND OF THE INVENTION

The invention relates to a display tube comprising a display screen and a neck accommodating an electron gun system for emitting an electron beam towards the display screen, and a deflection unit coaxially surrounding the display tube, which deflection unit comprises a line deflection coil system which, when energized, deflects the electron beam in a first direction and a field deflection coil system which, when energized, deflects the electron beam in a second direction transverse to the first direction, said deflection unit further comprising an annular correction coil which surrounds the path of the electron beam, is arranged transversely to the longitudinal axis of the tube and is connectable to a circuit providing a correction current for generating a correction magnetic field in the axial direction of the display tube.

The invention relates to both monochrome display tubes in which one electron beam is generated, and to colour display tubes in which three electron beams are generated.

In colour display tubes of the in-line type, the electron gun system is adapted to generate three coplanar electron beams which converge on the display screen. The deflection unit surrounding the display tube for deflecting the electron beams is used for deflecting the electron beams from their normal undeflected straight path into the one or the other direction so that the beams impinge upon selected pixels on the display screen on which they provide visual indications. By suitably varying the magnetic deflection fields, the electron beams can be moved up or down and to the left or the right across the (vertically arranged) display screen. By simultaneously varying the intensity of the beams, a visual presentation of information or a picture can be formed on the display screen. The deflection unit fixed around the cone section of the display tube comprises two deflection coil systems to enable the electron beams to be deflected in two directions which are transverse to each other. Each system comprises two coils arranged at opposite sides of the tube neck, with the systems being displaced about the tube neck by an angle of 90° relative to each other. Upon energization, the two deflection coil systems produce orthogonal deflection fields.

The fields are essentially perpendicular to the path of the undeflected electron beams. A cylindrical core of magnetizable material which surrounds the line deflection coil system if it is of the saddle type, is generally used for concentrating the deflection fields and for increasing the flux density in the deflection area.

The deflection coils may be of the saddle type or (particularly the field deflection coils) of the type which is toroidally wound on the annular core.

After mounting a deflection unit provided with field deflection coils and line deflection coils on the display tube for which it is intended, twist errors sometimes appear to occur in operation. Briefly summarized, the problem is that the three electron beams are not located in a horizontal plane when they leave the gun but in a plane which is somewhat tilted (for example 1 degree maximum; tilted about the tube axis). The beams are directed towards the centre of the screen, i.e. the convergence is satisfactory in the screen centre; upon deflection, however, the tilt becomes manifest as (mainly) vertical blue-red errors across all further screen points, which errors are referred to as BRy errors. This problem becomes urgent when very stringent requirements are imposed on the convergence such as in CMT and HDTV applications.

SUMMARY OF THE INVENTION

An effective twist correction means providing the possibility of setting the right correction (as far as size and sign are concerned) in each display tube separately is realised in that an annular coil surrounding the paths of the electron beams is arranged proximate to the entrance side of the deflection unit, which coil is connectable to a circuit providing a twist correction current for generating a correction magnetic field in the axial direction of the display tube.

This means operates as follows: because of the angle at which the side beams extend to the field lines of the correction coil, the side beams are first slightly deflected to one side (for example, blue up and red down) in a first area (to the left of the broken line in FIG. 2) and a little later to the other side in a second area to the right of the broken line. If the two effects have the correct intensity ratio, the three beams are in a horizontal plane after they have left the field of the correction coil and they still converge towards the centre of the screen. In a number of cases said intensity ratio is not exactly correct which in this case becomes manifest in a vertical blue-red error (BRy error) in the centre of the screen. The error depends on the z position and dimensions of the correction coil and may be, for example 0.5 to 1.5 mm (on a 32" 9:16, 110° tube). Since the mechanical design of coils is fixed, they cannot generally be freely chosen and cannot be used for reducing the BRy error in the centre. In this respect, the invention provides a solution which is characterized by the addition of an extra correction means.

An extra correction means to be added within the scope of the invention is:

a. Correcting the error by means of two static (4-pole) magnetic rings. Drawback: rings required+process of adjusting the rings.

b. Operating the correction coil with an alternating current instead of a direct current, in such a way that the value of the current is zero when the beams are present in the centre of the screen. Then there is no side effect in the centre of the screen. The current will then be, for example parabolic and vary with the frequency of the horizontal and/or vertical deflection. The circuit for generating such an alternating current is more expensive and consumes more energy than is required for a direct current.

c. Addition of a 4-pole y component to the (axial) twist correction field.

Deliberate, small deformations of the correction coil (normally extending in one plane transverse to the tube axis) may produce an extra 4-pole y component in the axial coil field, which component is adjusted in strength and sign by the extent and direction of the deformations. The required deformations often only need to be small (for example 1.5 mm). The total deformation is characterized in that the turns of the annular correction coil follow a path having four predetermined corrugations alternately facing the display screen and the gun system.

This 4-pole y component exactly corrects the BRy effect in the centre of the screen. The resultant correction, for DC control, (for the entire screen) is then substantially exactly the required correction without having to use magnetic tings or an AC circuit.

Embodiments:

A wire, wound around a cylindrical synthetic material support, in which the deformation is realised by winding in grooves provided in ribs longitudinally extending across the outer side of the support. The support is, for example the support of a scan velocity modulation coil. A coil wound with the desired corrugations in a jig and made self-supporting by "baking" it in the jig (heating by current passage so that the turns stick together) in the way in which coils are baked for deflection units (wire with a thermoplac coating). The self-supporting coil can then be mounted (for example, glued) somewhere in, at or on the synthetic material cap of the deflection unit.

Fields of application:

Applicable for all colour display tubes, both with the in-line gun and the delta gun, in those cases where the accurate correction of twist is necessary, particularly in tubes having a 9:16 aspect ratio of the display screen.

The invention has been explained hereinbefore with reference to a colour display tube provided with a twist correction coil. However, the invention is also applicable in any display tube in which a correction coil is used which generates a mainly axial field (field in the longitudinal direction of the display tube). An example is a display tube having an earth field compensation coil, more generally referred to as field rotation coil. Field rotation (or tilt), which may occur in colour display tubes as well as monochrome tubes, is often caused by the horizontal component (the field component parallel to the long axis of the display screen) of an external magnetic field, one source of which is the earth's magnetic field. When a (tilt) correction or (tilt) compensation coil is used for compensating the field rotation, such coil B being operated to generate an axial field, an error (a BRy error in a colour display tube) may also in this case be introduced in the centre of the display screen, which error can be remedied in the way as described hereinbefore. It is to be noted that field rotation coils are generally not arranged near the entrance side of the deflection unit, but at positions between the entrance side of the deflection unit and the display screen, more towards the display screen, for example near the exit side of the deflection unit. An example of such an arrangement is shown in the Philips Display Components Data Handbook of September 1990, pp. 429 and 430.

These and other aspects of the invention will be apparent from and elucidated with reference to the embodiments described hereinafter.

DESCRIPTION OF THE PREFERRED EMBODIMENTS

Figure 1:
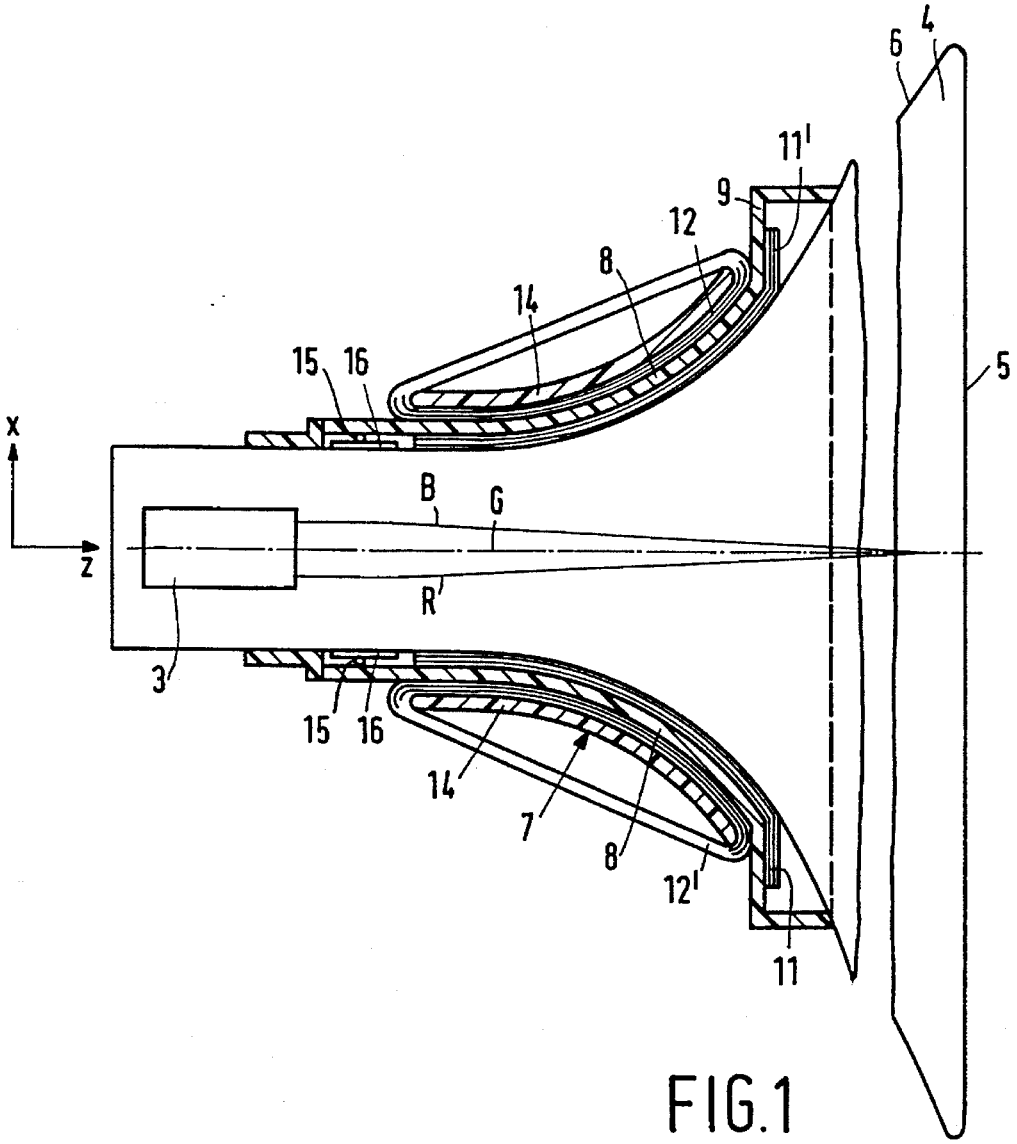
FIG. 1 is a diagrammatic elevational view of a cross-section (taken on the x–z plane) of a colour display tube provided with a deflection unit and a (twist) correction coil.
Figure 2:
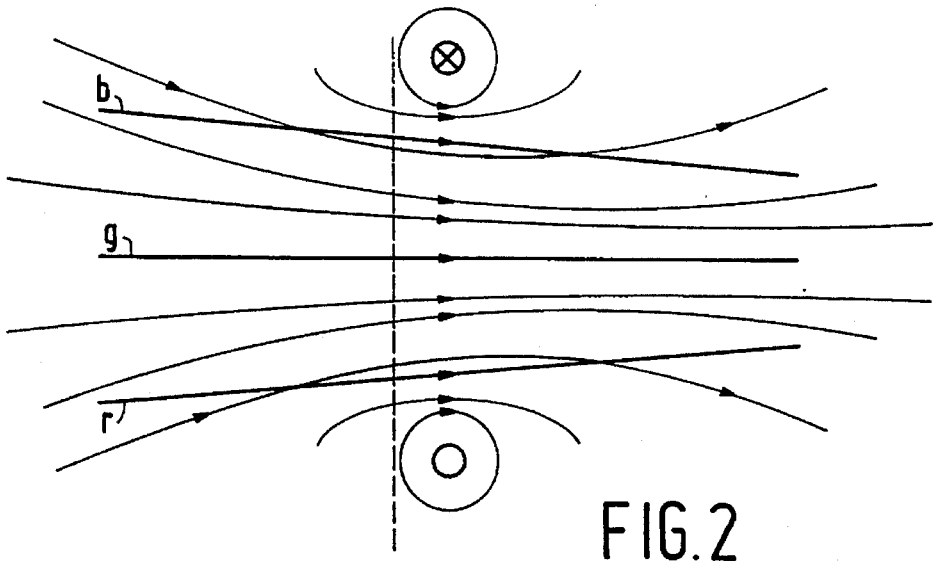
FIG. 2 shows the effect of the correction coil on the electron beams.

FIG. 1 shows, in a cross-section, a colour display tube 1 comprising an envelope 6 extending from a narrow neck portion accommodating an electron gun system 3 to a wide cone-shaped portion 4 which is provided with a display screen 5. A deflection unit 7 is mounted on the tube at the interface between the narrow and the wide portion. This deflection unit 7 comprises a support 8 of an electrically insulating material having a front end 9 and a rear end facing it at the opposite side. A deflection coil system 11, 11' for generating a (line) deflection field for deflection in the horizontal direction of electron beams produced by the electron gun system 3 is arranged between these front and rear ends at the inner side of the support 8. In this example the three electron beams R, B and G are located in one plane, i.e. the electron gun is of the in-line type. However, it may be alternatively of the delta type. The deflection coil system 11, 11' is surrounded by an annular core 14 of a magnetizable material on which, in this example, a set of coils 12, 12' is toroidally wound for generating a (field) deflection field for deflection in a vertical direction of electron beams produced by the electron gun system 3. The coils 11, 11' of the line deflection coil system are composed of a first side packet and a second side packet, and a rear end section (facing the gun 3) and a front end section (facing the display screen 5) jointly defining a window. In the Figure the rear end section is arranged fiat with respect to the front end section. However, the invention also relates to line deflection coils having a raised rear end section, or to any embodiments of line and field deflection coils, for example coils which are wound in grooves of the support 8.

In this case, an annular twist correction coil 15 surrounding the tube neck is added to the deflection unit 7.

'Twist' is the convergence error pattern which is produced on the screen as a result of, for example sealing the gun in a slightly rotated position. Twist becomes manifest as red-blue y errors at all screen points, except the centre. In addition to sealing spread, gun-on-frame errors, spreads in the mutual positioning of gun components and spreads in the deflection unit lead to twist.

Twist is a large and perhaps the largest individual source of convergence spread.

Said twist causes do not differ very much in magnitude. Consequently, it has been found to be difficult or even unfeasible to deal with the causes of twist errors and the attention focuses on correction methods afterwards.

An annular coil around the neck of the tube (somewhere in the area beyond the main lens, near the entrance side of the deflection coil) results in a twist effect upon energization with a DC current. Thus, such a coil can be used for twist correction. It has, however, the drawback of a BRy effect at point A (centre of the display screen). The latter drawback can be eliminated in a more advantageous manner than with said other means by adding an extra 4-pole y component to the correction field, for example, in the manner described hereinafter.

Figure 3A:
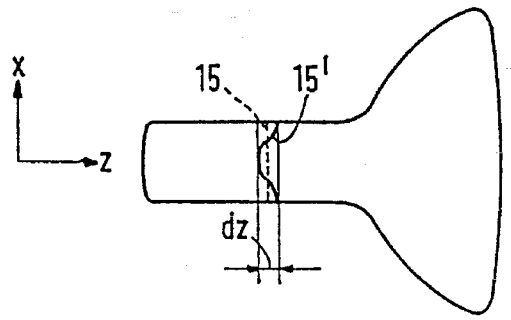
FIG. 3A is a plan/bottom view and FIG. 3B is a side view of a tube envelope with a special embodiment of a (twist) correction coil.
Figure 3B:
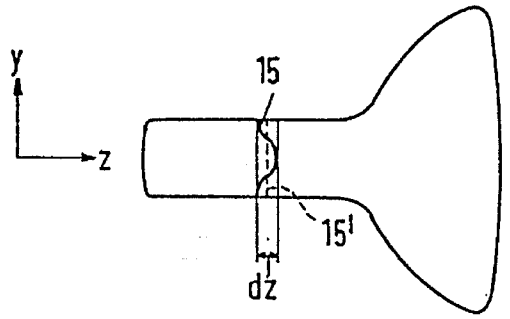

What is required is an additional 4py effect having the correct sign and the correct strength. This can be realised by slightly deforming the coil, as is diagrammatically shown in FIGS. 3 and 4. In these cases an annular coil having a circular basic shape whose turns extend in one plane transverse to the tube axis has been used. However, the invention is not limited to a coil having a circular basic shape. Any coil which generates mainly an axially directed field is suitable, for example also a coil having a square basic shape.

Figure 6:
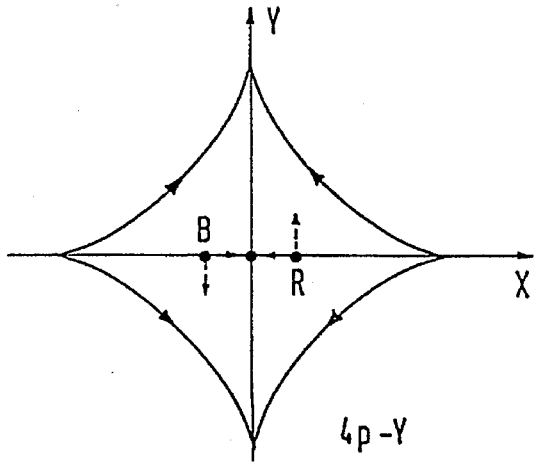
FIG. 6 shows the 4-pole y field to be generated by a coil of the type shown in FIG. 3 or 4.

The difference between the deformed coil 15' and the undeformed coil 15 shown in broken lines is 4 current loops at the top, the left, the bottom and the right, whose magnetic field direction alternately faces the one and the other side. These 4 loops exactly generate a 4py component. The strength and orientation of this 4py can be adjusted by the choice of the size of the "loops" and the direction in which the current flows through them. FIG. 6 shows an example of the 4-pole y field which is generated thereby and displaces the outer beams in opposite, vertical (y) directions. Dependent on the BRy(A) deviation which can be admitted, and the z position with respect to the entrance side of the deflection unit, dz is between 0 and 10 mm in practical cases, and particularly between 0.5 and 5 min. The size of the loops and the direction of the current in the loops can be chosen in such a way that the effect on BRy(A) of the coil as a whole is zero.

When an unreformed annular correction coil is used, the effect at point A appears to be dependent on the z position and the diameter of the coil. Now there is much more freedom in the choice of the z position and the diameter when the abovementioned solution is used, because the design need not be based on a minimal effect at A.

Figure 4:
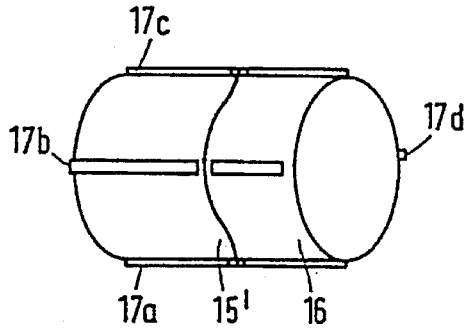
FIG. 4 is a diagrammatic perspective elevational view of a cylindrical support with a (twist) correction coil of the type shown in FIG. 3.

If the deflection unit already includes a scan velocity modulation device having a hollow cylindrical synthetic material support 16 (FIG. 1, FIG. 4) whose inner surface supports a scan velocity coil system, it will be practical to arrange the twist correction coil 15' on the outer surface of the support 16 (FIG. 4). The support 16 may be provided, for example with external longitudinal ribs 17*a* . . . 17*d* (four in this case) in which grooves are provided to accommodate the tums of the coil 15'.

Figure 5A:
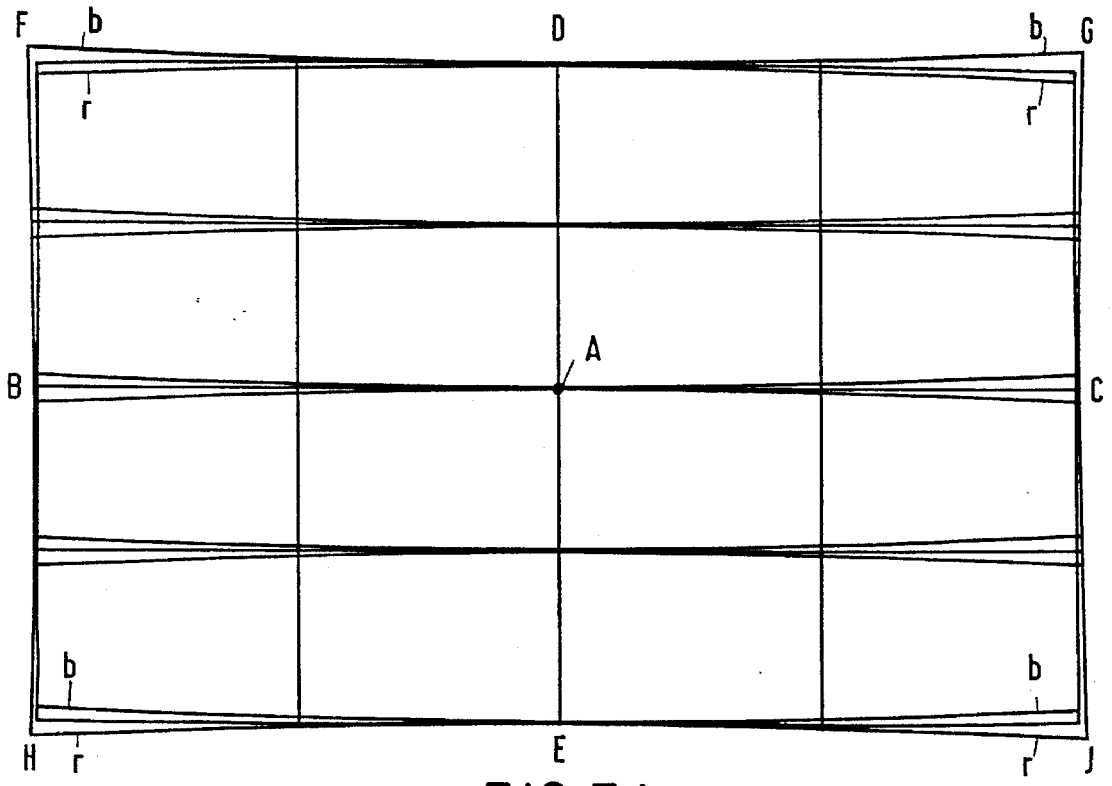
FIG. 5A shows diagrammatically a raster on the display window of a colour display tube and FIG. 5B shows the correction pattern of an embodiment of a twist correction coil.
Figure 5B:
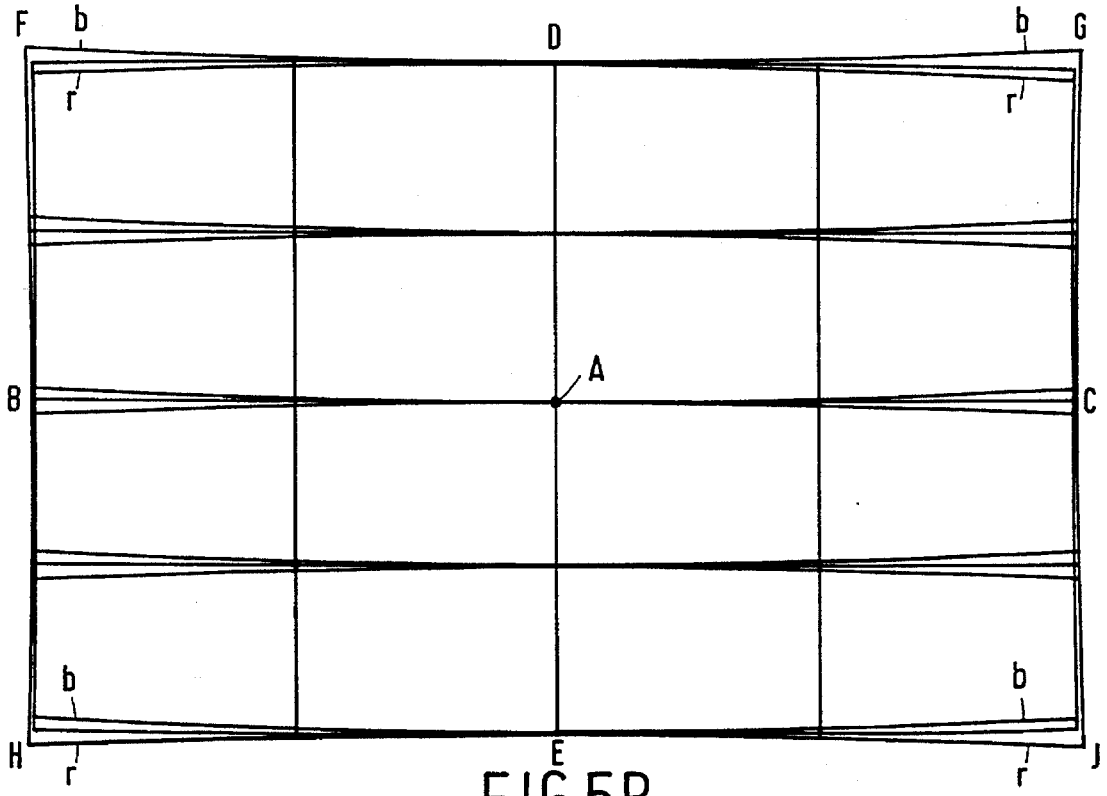

FIG. 5B is a graphic representation of the correction pattern of this coil and, for the purpose of comparison, FIG. 5A shows the error pattern to be corrected as occurs in, for example gun rotation: both patterns are substantially identical.

TABLE

Comparison of the effect of a twist correction coil at position z = 19.5 mm and dz = 1.54 mm with the BRy error pattern to be corrected, which is the result of 0.6° gun rotation.

| | Twist error at 0.6° gun rotation | Effect of corr. coil (13 A.w) |
|---|---|---|
| BRy (B/C) | 0.40 mm | 0.40 mm |
| BRy (F/G/H/J) | 0.49 mm | 0.50 mm |
| BRy (D/E) | 0.13 mm | 0.11 mm |

The required drive power is preferably 1 Watt at a maximum (from a 5 V or 13 V voltage source). This has consequences for the choice of the wire diameter and the number of coil tums. For a correction from 0.5 to 1 mm line twist (BRy at the points B and C) several dozen to several hundred tums, dependent on the wire thickness, are found to be necessary in practice.

I claim:

1. A display tube comprising a display screen and a neck accommodating an electron gun system for emitting an electron beam towards the display screen, and a deflection unit coaxially surrounding the display tube, which deflection unit comprises a line deflection coil system which, when energized, deflects the electron beam in a first direction and a field deflection coil system which, when energized, deflects the electron beam in a second direction transverse to the first direction, said deflection unit further comprising an annular correction coil which surrounds the path of the electron beam, is arranged transversely to the longitudinal axis of the tube and is connectable to a circuit providing a correction current for generating a correction magnetic field in the axial direction of the display tube, said correction magnetic field correcting errors outside the centre of the display screen and said deflection unit comprising an additional correction means for correcting errors in the centre of the display screen.

2. A display tube as claimed in claim 1, where, in operation, the additional correction means generates a 4-pole y magnetic field component.

3. A display tube as claimed in claim 1, where the additional correction means is formed in that the turns of the annular coil follow a path having four predetermined corrugations alternately facing the display screen and the gun system.

4. A display tube as claimed in claim 3, where the annular coil extends in the axial direction of the display tube across a distance dz, with 0<dz<10 mm.

5. A display tube as claimed in claim 1, in which the electron gun system is adapted to emit three coplanar electron beams towards the display screen, and where the annular correction coil is arranged proximate to the entrance side of the deflection unit, surrounds the paths of the electron beams and is connectable to a circuit providing a twist correction current for generating a twist correction field.

6. A display tube as claimed in claim 1, in which the annular correction coil is arranged at a position located between the entrance side of the deflection unit and the display screen and is connectable to a circuit providing a field rotation compensation current for generating a field rotation compensation field.

* * * * *